US009591921B2

(12) United States Patent
Valdivia

(10) Patent No.: US 9,591,921 B2
(45) Date of Patent: Mar. 14, 2017

(54) RECLINER LAPTOP DESK

(76) Inventor: Jesus Valdivia, Pico Rivera, CA (US)

( * ) Notice: Subject to any disclaimer, the term of this patent is extended or adjusted under 35 U.S.C. 154(b) by 0 days.

(21) Appl. No.: 12/804,634

(22) Filed: Jul. 26, 2010

(65) Prior Publication Data

US 2011/0017105 A1 Jan. 27, 2011

Related U.S. Application Data

(60) Provisional application No. 61/271,725, filed on Jul. 24, 2009.

(51) Int. Cl.
*A47B 23/00* (2006.01)
*A47B 23/04* (2006.01)

(52) U.S. Cl.
CPC ..... *A47B 23/043* (2013.01)

(58) Field of Classification Search
USPC ..... 108/42–46, 50.11, 50.14, 90; 297/148–155
See application file for complete search history.

(56) References Cited

U.S. PATENT DOCUMENTS 1,035,290 A * 8/1912 Wood ..... A47B 23/002 248/444
1,232,089 A * 7/1917 Riebe ..... 108/43
1,247,161 A * 11/1917 Silverman ..... A47C 1/11 297/148
1,478,780 A * 12/1923 Akesson ..... 297/149
2,034,835 A * 3/1936 Rubino ..... 297/161
2,244,773 A * 6/1941 Hawk ..... 248/451
3,123,935 A * 3/1964 Williams ..... 248/346.01
3,258,237 A * 6/1966 Beiman ..... 248/220.31
3,417,875 A * 12/1968 Barker ..... 211/86.01
3,475,052 A * 10/1969 Kaposi ..... 297/153
3,698,328 A * 10/1972 Weir ..... 108/6
3,828,994 A * 8/1974 Hollins ..... 224/275
D246,403 S * 11/1977 Tempchin ..... D6/525
4,404,698 A * 9/1983 Koncelik et al. ..... 5/507.1
4,506,928 A * 3/1985 Marion ..... 297/174 CS
(Continued)

*Primary Examiner* — Daniel J Troy
*Assistant Examiner* — Timothy M Ayres

(57) ABSTRACT

A non obstructive laptop desk and chair apparatus which combines the use of a laptop computer with the use of a recliner armchair is disclosed. The laptop desk and chair apparatus comprises a recliner armchair having a chair seat, an angular adjustable back, a pair of armrests each with an upper arm surface, a board having upper and lower flat surfaces and a front side configured to be adjacent a user. A leg assembly attached to the front half of the lower flat surface of the board includes a pair of feet that are elongated cylindrical in shape and include a friction enhancing surface. A strap attached via hooks and eyelets to the front two corners of the upper flat surface of the board extends around a portion of the recliner armchair between the angular adjustable back and the chair arms. The board with a load such as a portable electronic device secured to the upper surface of said board pivots around the feet to a plurality of angular orientations including a substantially horizontal position by resting each foot on one of the arm rests of said recliner armchair and balancing the board with the load by adjusting the length of the strap around the chair or by pivoting the hooks about the eyelets.

7 Claims, 8 Drawing Sheets

(56) References Cited

U.S. PATENT DOCUMENTS

| | | | | | |
|---|---|---|---|---|---|
| 5,244,250 | A | * | 9/1993 | Nordmeyer | A47C 4/44 297/28 |
| D355,636 | S | * | 2/1995 | Dickerson et al. | D12/419 |
| 5,848,828 | A | * | 12/1998 | MacLellan | 312/291 |
| 6,044,758 | A | * | 4/2000 | Drake | 100/43 |
| 6,354,658 | B1 | * | 3/2002 | Sher et al. | 297/188.14 |
| 6,496,360 | B1 | * | 12/2002 | Cordes et al. | 361/679.09 |
| 6,659,545 | B1 | * | 12/2003 | McMillan | 297/153 |
| 6,773,060 | B2 | * | 8/2004 | Sher et al. | 297/188.14 |
| 7,293,751 | B2 | * | 11/2007 | Eriksson | 248/346.01 |
| 7,862,111 | B2 | * | 1/2011 | Steenson | 297/161 |
| 2006/0011107 | A1 | * | 1/2006 | Chang | 108/42 |
| 2007/0012827 | A1 | * | 1/2007 | Fu et al. | 248/163.1 |
| 2007/0028812 | A1 | * | 2/2007 | Dumond | 108/36 |
| 2008/0282940 | A1 | * | 11/2008 | Marion | A47B 23/00 108/43 |

* cited by examiner

RECLINER LAPTOP DESK

CROSS-REFERENCE TO RELATED APPLICATION

This application claims the benefit of the provisional patent application no. 61/271/725 filed on Jul. 24, 2009.

FEDERALLY SPONSORED RESEARCH

None

SEQUENCE LISTING OR PROGRAM

None

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to laptop computer desks and more particularly to an adjustable laptop computer workstation for comfortable laptop computing from a reclined or sitting position.

Today, computer use is on the rise among the young and old. Computers are used by more people, more often, and for longer periods of time. Many people now work from home, watch movies, read books, and take college courses online. While many individuals still use the traditional desktop computer for such activities, more and more people are opting for the convenience of a laptop computer. Indeed, laptop computers are now frequently employed in situations where the user is reclining or sitting in a comfortable chair without the use of a desk. Usually, the laptop computer rests on the user's lap, the user's back is hunched and the neck and eyes are strained as the body adjusts to the minimal screen and keyboard positions available. Although such a position can be comfortable for a few minutes, an important impediment to maintaining such a position is the discomfort which naturally arises from being in such a position for a lengthy period of time. While this is especially true for sickly and elderly individuals, the young and healthy eventually suffer health consequences as well. In addition, the computer is usually not ventilating and gets hot, causing further discomfort and possible damage to the computer.

Various efforts to address health issues related to desktop computer use have been made such as ergonomic chairs, desks and keyboards, however, little has been done to address health issues related to laptop computer use. Those configurations designed for use with laptop computers heretofore proved largely unsuccessful primarily due to their complexity in attempting to address mobility and due to their bulky, lap obstructing, unstable, non-secured leg support design. An example of such devices includes US 2007/0012827 A1, Pub. Date Jan. 18, 2007, inventors Pide Fu; June Liu which discloses a portable support device for holding a laptop computer or other load object on a tiltable support board for viewing and operation by a person situated in any of a variety of body position, including sitting, lying, and reclining in a variety of indoor and outdoor locations. The tiltable support board may accordingly be positioned and locked into a variety of angular inclinations with respect to a structure of the portable support device while the laptop computer or other load is securely displayed to the situated user. This device is unsuitable for use with a recliner armchair due to its bulky leg support structure and inability to be secured to a recliner armchair in order to provide stability.

U.S. Pat. No. 6,044,758 issued to Drake on Apr. 4, 2000 presents a desk unit that is adaptable for multiple uses by a user in a seated or reclining position by placing the desk over the user's lap. The desk is fully portable and foldable, but because of its relatively large leg structure, it too would obstruct the user's lap. Additionally, there is no means for securing the desk to the armchair for stability and the distance between the legs is not adjustable, thereby rendering it unsuitable for recliner arm chairs of varying arm rest distances.

Another such device is described in U.S. Pat. No. 6,496,360 to Cordes on Dec. 17, 2002 which discloses a portable computer laptop desk that, when attached to a structure, is in turn supported on web strapping that passes over the upper legs of the operator when in the seated position. The strapping is attached to foldable and telescopable side and center supports for the structure that slide into and fold over the structure forming a package comparable in size to the portable computer. While this desk is certainly portable, the strapping support is obstructive while on the user's lap and this desk has no means for securing it to a recliner armchair. It is therefore unsuitable for use with a recliner armchair.

Most of the above configurations are generally unsightly and fail to provide the necessary space and support system for multi task desktop work requiring more than just a laptop computer. They are not securable to a recliner armchair and have the significant disadvantage of obstructing the user's lap because of bulky leg support systems. Other configurations such as the one disclosed in U.S. Pat. No. 6,773,060 issued to Sher et al. on Aug. 10, 2004 cannot operate with armchairs that have only upper chair arm surfaces such as the one depicted in FIG. 6 of the present disclosure. The present invention overcomes this limitation as it can operate with the type of chair described in the Sher disclosure as well as chairs with only an upper chair arm surface.

It is an object of the present invention to convert a recliner armchair into a readily adjustable workstation capable of simultaneously accommodating and supporting a laptop computer with other desktop accessories such as a notebook, book or calculator in a secure, non obstructive manner. It is another object of the present invention to provide a non-obstructive laptop desk and chair apparatus which can be pivotably balanced in a plurality of angular orientations and distances from user, on the arm rests of a recliner armchair, thereby permitting for long periods of comfortable, ergonomic laptop computing. It is another object of the present invention to provide a highly and readily adjustable workstation for other tabletop activities such as eating, doing crafts, movie watching and podium style hands free reading in a comfortable sitting position. It is another object of the present invention to provide a laptop computer support system that frees the user's lap from the discomfort of supporting a computer or any other desktop accessory. It is another object of the present invention to provide flexibility in positioning of desktop accessories utilizing a peg hook accessory support system. It is yet another object of the present invention to put users where they usually want to be, in their recliner armchair in front of the TV. It is another object of the present invention to allow for laptop computing comfort with a wide array of screen and keyboard positions available for optimal wrist, arm and spinal alignments. Other objects of the present invention will become better understood with reference to appended Summary, Description and Claims.

SUMMARY

Recliner armchairs are found in millions of living rooms, bedrooms and dens around the world. They are designed to follow the natural curves of the spine while providing full lumbar and upper back support. They encourage natural relaxation and offer many position changes that aid in circulation. Briefly, the present invention is a spacious, versatile, highly and readily adjustable laptop computer desk and chair apparatus that incorporates the indisputable comfort and health benefit of sitting in a recliner armchair with the use of a laptop computer. The principles of leverage, gravitational rotation, friction, balance and tension are readily and easily controlled by a user sitting on a recliner armchair such that a desk with a laptop computer aboard is readily and easily balanced on the armrest of the chair into a wide array of screen and keyboard positions available for ergonomic use of a laptop computer with optimal wrist, arm and spinal alignments.

The recliner laptop desk and chair apparatus includes a flat surface board adapted to securely receive a load such as a laptop computer. A pegboard area and at least one peg hook provide a system of support and flexibility in positioning the computer on the pegboard area of the board, and an accessory strap inserted through a plurality of accessory strap slots is utilized for securing the computer against the board. The apparatus further includes a plurality of mouse pad areas on the board adjacent user and a front and rear raised border included as a secondary stop measure to prevent gravitational sliding of desktop accessories. A pivotable, height and width adjustable leg assembly attached to the lower surface of the board adjusts for chairs and users of varying sizes. Each of two end portions of the adjustable leg assembly includes a foot comprised of an elongated cylinder with a friction enhancing surface. Said friction enhancing surface is comprised of a resilient material and ridges which are substantially parallel with the elongation of the feet and which create friction to resist gravitational rotation as the feet pivotably rest on the chair armrests. The feet of the adjustable leg assembly are centered on the chair armrests. Tension from an adjustable tension strap that is detachably attached in a non obstructive manner to the front two corners of the flat surface board and extended around a portion of the recliner chair between the angular adjustable back and the chair arms controls gravitational rotation of the board and collaborates with the friction of the feet against the upper surface of the chair armrests to balance the desk. From a sitting position, a user can adjust the strap length, manually lift and move, roll or pivot the laptop desk to balance in a predetermined position.

In conclusion, the principles of leverage, gravitational rotation control, friction, balance and tension control are combined to create a highly adjustable laptop desk and chair apparatus which can be pivotably balanced on the arm rests of a recliner armchair. The novel non obstructive support system and the many adjustable components of the apparatus yield a highly versatile laptop computer workstation that requires no user bodily support. From a sitting position, a user can control strap tension, lift and move, roll or pivot a laptop desk into a stable state of balance at a predetermined angular orientation with respect to user and at a predetermined distance from user. The degree of desk stability when balanced is such that the apparatus can simultaneously accommodate and support a laptop computer with other desktop accessories such as a notebook, book or calculator and can also be used for other activities such as eating, doing crafts, movie watching and podium style hands free reading in a secure, non obstructive manner.

Although particular embodiments of the present invention have been described in the foregoing description, it is to be understood that the present invention is not to be limited to just the embodiments disclosed, but that they are capable of numerous rearrangements, modifications and substitutions without departing from the description herein.

REFERENCE NUMERALS

Figure 1:
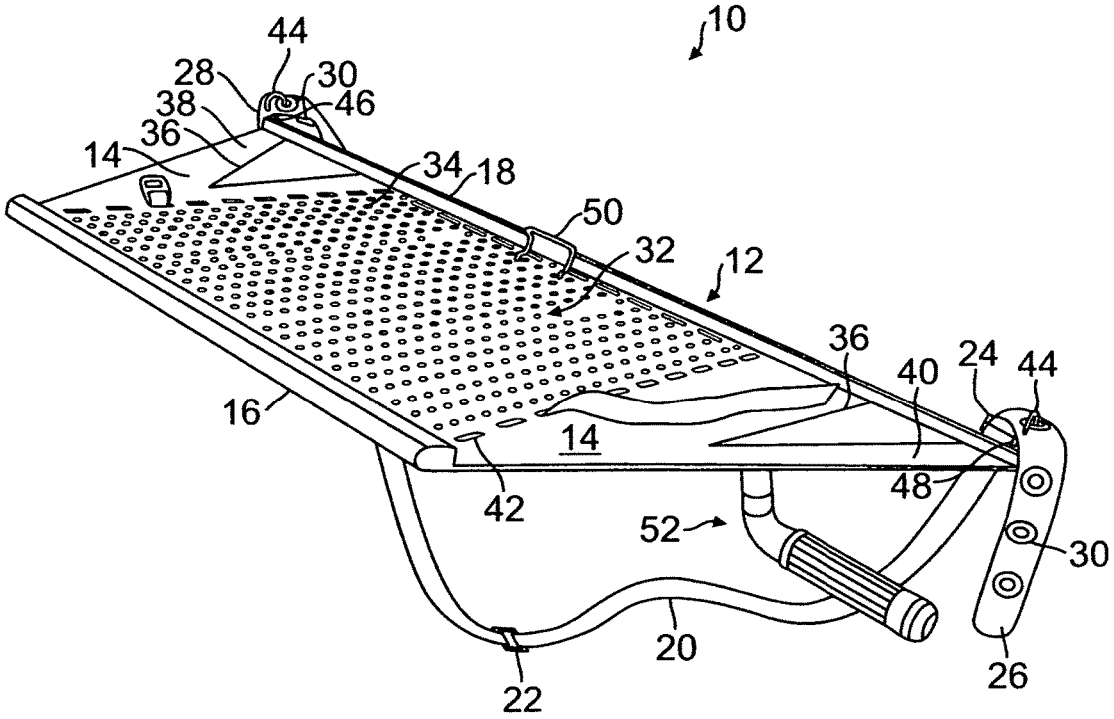
FIG. 1 is a side perspective view of a laptop desk in accordance with the present invention.

10 . . . Laptop desk
12 . . . Flat surface board
14 . . . Upper surface of the flat surface board
16 . . . Rear raised border of the flat surface board
18 . . . Front raised border of the flat surface board
20 . . . Tension strap
22 . . . End union of the tension strap
24 . . . A plurality of glide type strap adjusters of the tension strap
26 . . . First end of the tension strap
28 . . . Second end of the tension strap
30 . . . A plurality of eyelet apertures of the tension strap
32 . . . Pegboard area of the flat surface board
34 . . . A plurality of holes of the peg board area
36 . . . A plurality of mouse pad areas of the flat surface board
38 . . . Front left side of the flat surface board
40 . . . Front right side of the flat surface board
42 . . . A plurality of accessory strap slots of the flat surface board
44 . . . A pair of hooks of the flat surface board
46 . . . Front left end of the flat surface board
48 . . . Front right end of the flat surface board
50 . . . At least one peg hook
52 . . . A leg assembly
54 . . . Lower surface of the flat surface board
56 . . . Axle housing
58 . . . A pair of desk mounts
59 . . . A welded nut
60 . . . Spring loaded pop pin
62 . . . A pair of reducer couplings

64 . . . A pair of axle extensions
65 . . . Leg height adjustment spring button and apertures
66 . . . A pair of adjustable leg portions
67 . . . Leg width adjustment spring button and apertures
68 . . . A pair of elongated cylindrical leg assembly feet with a friction enhancing surface.
69 . . . A pair of spring buttons on axle extensions
70 . . . Axle
72, 74 . . . Pair of ends of the axle
76 . . . A plurality of holes of the axle
78 . . . Pop pin aperture
80, 82 . . . Terminal ends of the peg hook
83 . . . Arm rests
84 . . . A user
85 . . . Armchair
86 . . . Laptop computer
88 . . . Chair backrest
96 . . . Hook and loop accessory strap

DETAILED DESCRIPTION

Referring to the drawings, a preferred embodiment of a laptop desk 10 is illustrated and generally indicated as 10 in FIGS. 1 through 8. Referring to FIG. 1, the laptop desk 10 comprises a flat surface board 12 having an upper surface 14, a lower surface (not shown), a rear raised border 16 and a front raised border 18, a tension strap 20 having a strap end union 22, a plurality of glide type strap adjusters 24, a first strap end 26 and a second strap end 28. The first and second strap ends 26, 28 include a plurality of eyelet apertures 30. The flat surface board 12 is defined by a pegboard area 32 having a plurality of holes 34, a plurality of mouse pad areas 36 on front left side 38 and on front right side 40, a plurality of accessory strap slots 42 throughout the pegboard area 32, a pair of hooks 44 attached at the front left end 46 and front right end 48, at least one peg hook 50 and a leg assembly 52.

The flat surface board 12 provides an area for a user to place accessories such as a laptop computer, book, writing instrument or document. The rear and front raised borders 16 and 18 of the flat surface board 12 provide a stop to prevent desktop accessories from sliding off the flat surface board 12 when positioned at steep angles. The plurality of holes 34 provides ventilation for a laptop computer as it rests on the flat surface board 12 and also serves as a means for attachment of the at least one peg hook 50 which can be attached throughout the plurality of holes 34 to support desktop accessories.

Figure 2:
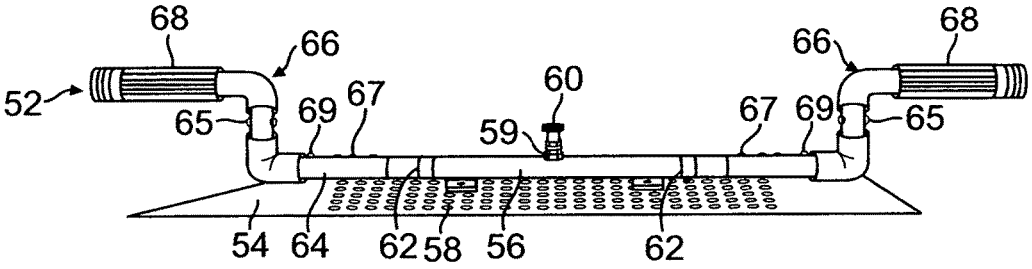
FIG. 2 illustrates a lower surface of a flat surface board with a leg assembly attached in accordance with the present invention.

FIG. 2 shows the lower surface of the flat surface board 54 with the leg assembly 52. The leg assembly 52 is mounted to the lower surface of the board and comprises an axle housing 56 having a pair of desk mounts 58, a welded nut 59, an axle (not shown) and a spring loaded pop pin 60 threadably engaged with the welded nut 59, a pair of reducer couplings 62, each being attached to one end of the axle (not shown), a pair of axle extensions 64 each having a spring button 69 connected to the axle 70 by way of the pair of reducer couplings 62, and a pair of adjustable leg portions 66 engaged with the axle extensions 64 through spring buttons 69. The pair of adjustable leg portions 66 includes a pair of elongated cylindrical leg assembly feet 68 with a friction enhancing surface to enhance friction for desktop stability as they rest on the upper surface of the recliner chair armrests. The pair of adjustable leg portions 66 engage the axle extension 64 by way of spring buttons and spring button apertures 67 which provide a means for adjusting the width of the leg assembly so that the pair of elongated cylindrical leg assembly feet 68 can be centered on the armrests of the chair. The pair of adjustable leg portions 66 also comprise a second plurality of spring button apertures and spring buttons 65 for adjusting the height of the pair of adjustable leg portions. The desk mounts 58 are attached to the lower surface of the flat surface board 54 with screws.

Figure 3:
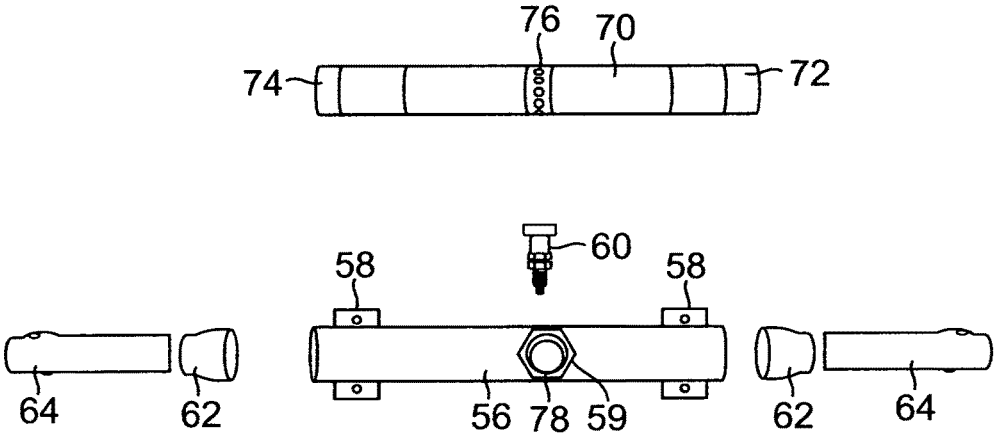
FIG. 3 is an exploded view of the axle, axle housing and axle extensions.
Figure 8:
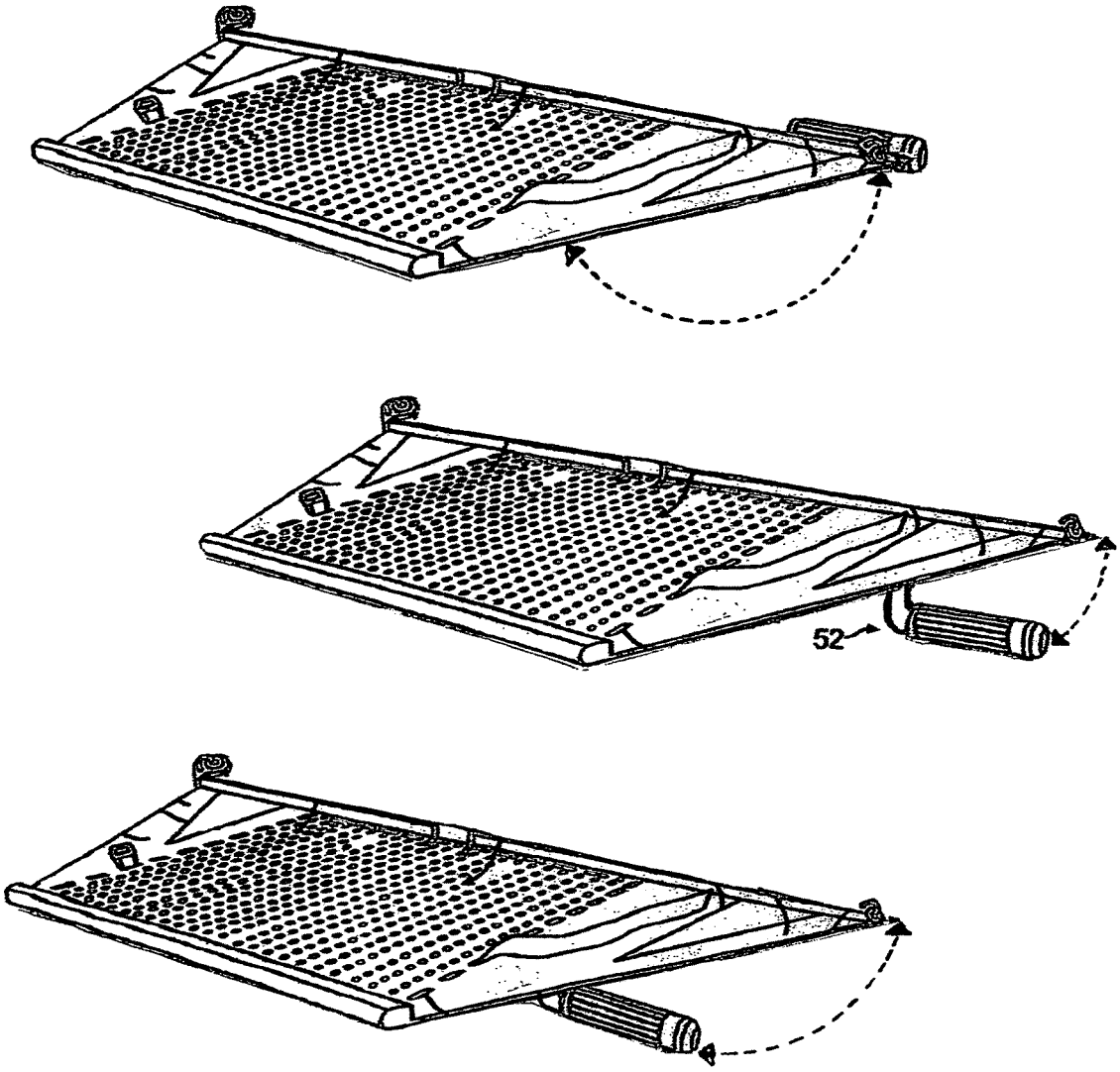
FIG. 8 illustrates the legs locked in 3 of a plurality of leg positions available.

FIG. 3 is an exploded view of the axle 70, axle housing 56 and axle extensions 64. The axle 70 having a pair of ends 72, 74 is adapted for insertion into axle housing 56. The axle 70 has a smaller diameter than the axle housing 56 thereby permitting insertion into the axle housing 56. The axle 70 includes a plurality of holes 76 along the center line of the axle 70 which align with the pop pin aperture 78 in the axle housing 56. The plurality of holes 76 receive the spring loaded pop pin 60 through the welded nut 59 and the pop pin aperture 78 to lock in different leg positions as depicted in FIG. 8. The pair of reducer couplings 62 prevent the axle 70 from sliding longitudinally within the axle housing 56 by butting up against the ends of the axle housing 56.

Figure 4:
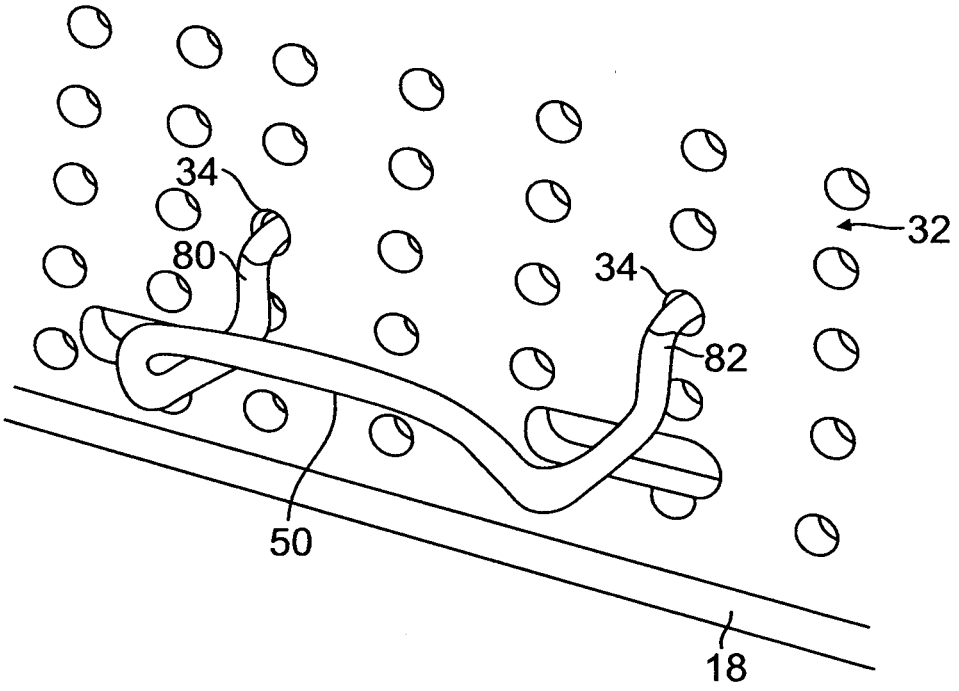
FIG. 4 is a side perspective view of at least one peg hook inserted to a pair of holes on a pegboard area.

FIG. 4 illustrates the at least one peg hook 50 inserted to a pair of holes 34 on the pegboard area 32. The peg hook 50 includes a first terminal end 80 and a second terminal end 82, each terminal end 80, 82 being inserted to the pair of holes 34 on the pegboard area 32. The peg hook 50 can be easily attached and detached from the pegboard area 32 and repositioned throughout the pegboard area 32 of the flat surface board 12 to support desktop accessories of various sizes throughout the pegboard area 32. The peg hook 50 can be easily moved and provides flexibility in balancing the desktop accessory by changing the distance of the desktop accessory from the elongated cylindrical leg assembly feet 68 as they rest on the chair arm rests. One or more peg hooks 50 may be used to support accessories at an increased or decreased distance from the user for optimal wrist and arm alignment. The peg hook 50 is of an eyelet type design so as to minimize blockage of computer accessory inputs located on the front side of the laptop computer.

Figure 5:
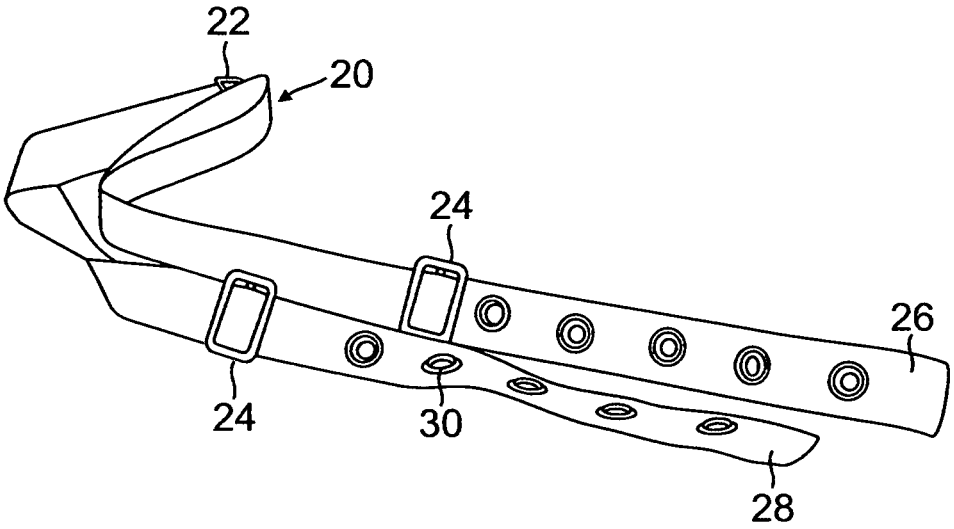
FIG. 5 is a perspective view of the tension strap of the present invention.

FIG. 5 is a perspective view of the tension strap 20 of the present invention. The tension strap 20 includes a strap end union 22, a plurality of glide type strap adjusters 24, a first strap end 26 and a second strap end 28. The first and second strap ends 26, 28 include a plurality of eyelet apertures 30. The strap end union 22 unites two portions of said strap 20 which extends around a portion of the recliner armchair between the angular adjustable back and the chair arms. The plurality of glide type strap adjusters 24 are reachable from the user sitting position and adjust the length of tension strap 20 thereby accommodating chairs of varying sizes. The eyelet apertures 30 on both ends 26, 28 of tension strap 20 engage with the hooks 44 positioned at the front left end 46 and front right end 48 of the flat surface board 12.

Figure 6:
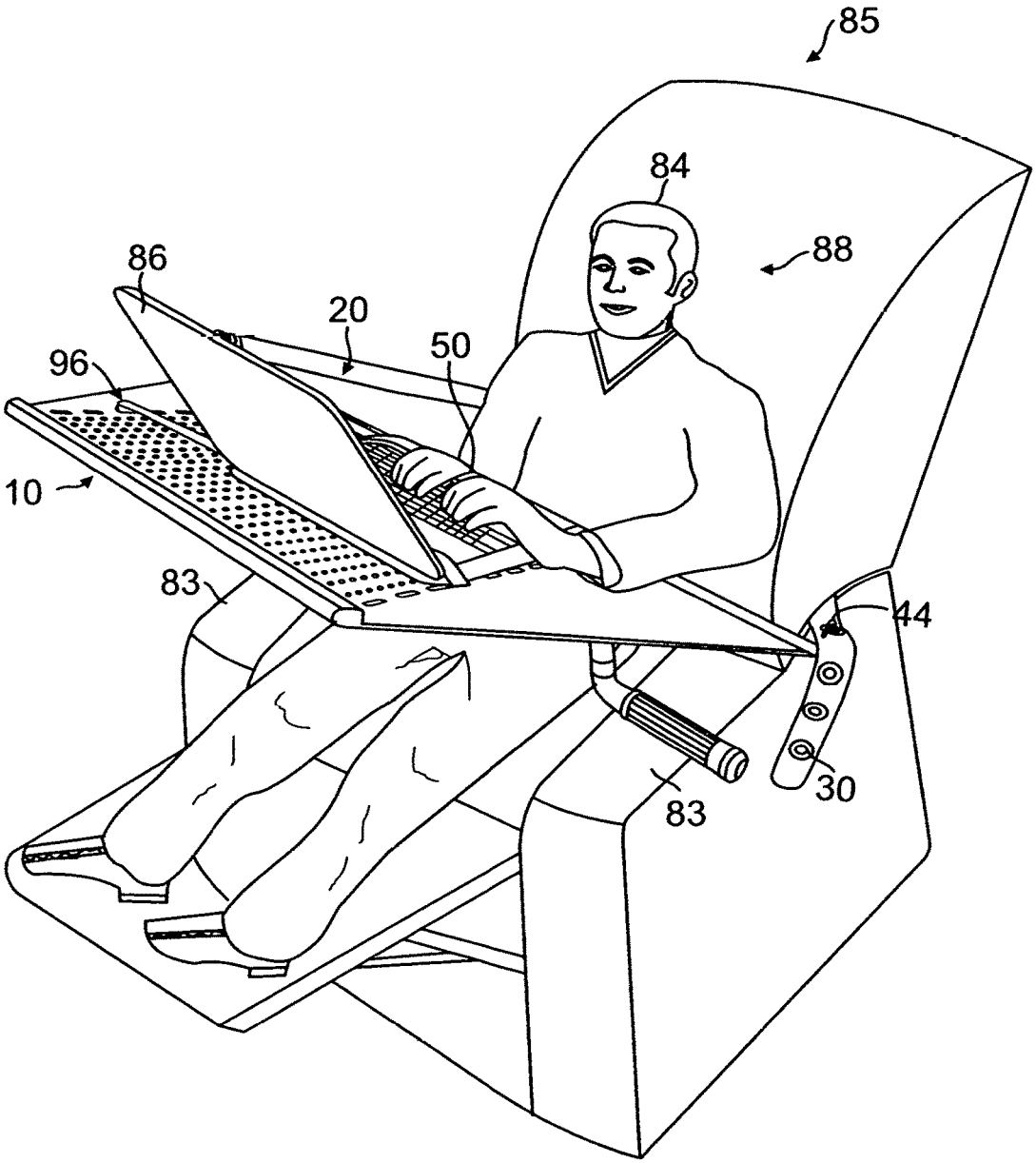
FIG. 6 is a perspective view of the laptop desk and chair apparatus in use with the user in a reclined position and with the desk balanced on the armrests of a recliner chair.
Figure 7:
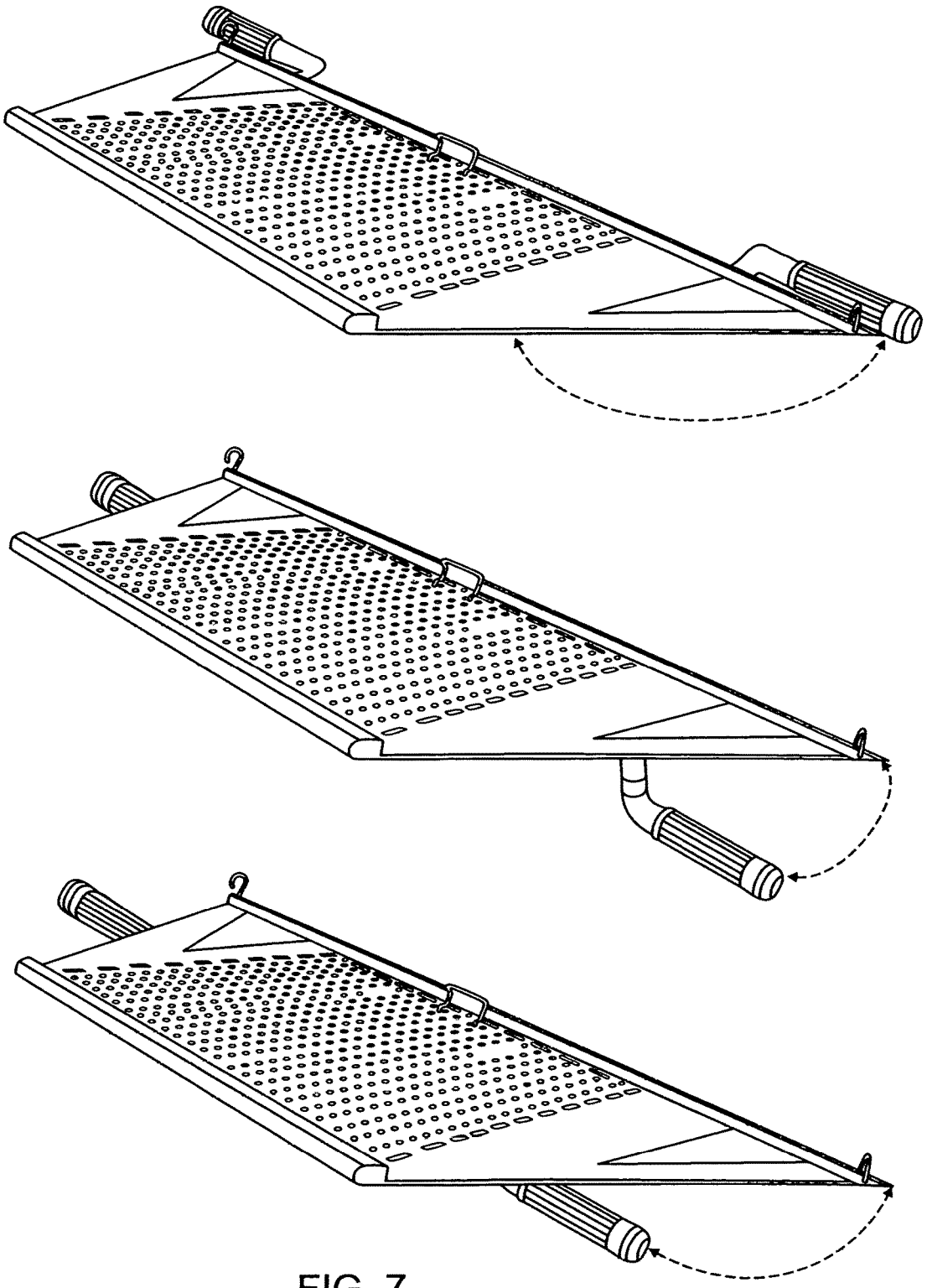

FIG. 6 illustrates a perspective view of the laptop desk 10 in use. The laptop desk 10 is pivotably balanced and stabilized on the arm rests 83 of the armchair 85 at a predetermined distance from a user 84 and at a predetermined angular orientation with respect to the user 84. From a sitting position, the user 84 can readily adjust the distance of the laptop desk 10 and angular orientation of the laptop desk 10 to a state of balance in one of many available positions for comfortable, relaxing, and ergonomic use of the laptop computer 86. The configuration is such that the laptop desk 10 can simultaneously accommodate and support a laptop computer 86 along with other desktop accessories necessary for multitasking.

The selection of a particular eyelet aperture from the segment of eyelet apertures 30 to engage with the hooks 44 provides means for small strap length adjustments to create necessary strap tension for controlling gravitational rotation of the laptop desk 10. Either the flat surface board 12 or the tension strap 20 can have the eyelet or hooks, as long as the tension strap 20 attaches to the flat surface board 12. An adjustment of strap length is utilized to control angular orientation of the laptop desk 10 at balance. At a fixed distance of the leg assembly feet 68 from the chair backrest 88, engagement of the eyelets 30 to the hooks 44 which results in a shorter strap length creates tension to the tension strap 20 allowing less of a gravitational downward desk pivot. Engagement of the eyelets 30 resulting in a longer strap length adjusts tension to the tension strap 20 allowing more of a gravitational downward desk pivot. Once the tension strap 20 is engaged with the hooks, and with tension applied, additional manipulation of the laptop desk's angular orientation can be achieved by pivoting the hooks 44 about the eyelet apertures 30 thereby manually increasing or decreasing the distance of the leg assembly feet 68 from the chair backrest 88 and causing the laptop desk 10 to pivot. At a fixed distance of the leg assembly feet 68 from the chair backrest 88, forward or backward movement of the chair backrest 88 increases or decreases strap tension which causes the laptop desk 10 to pivot. A backward motion of the chair backrest 88 increases strap tension, pulls on the desk 10, and triggers a desk pivot in the same direction as chair backrest 88. Similarly, a forward motion of the chair backrest 88 releases the strap tension and triggers a gravitational desk pivot in same direction as the chair backrest 88. For stability of the laptop computer on the flat surface board, a hook and loop accessory strap 96 is inserted through the plurality of accessory strap slots of the flat surface board 42 and wraps around the laptop computer.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A laptop desk and chair apparatus, comprising:

a recliner armchair having a chair seat, an angular adjustable back, and a pair of armrests each with an upper arm surface;

a board having upper and lower flat surfaces and a front side configured to be adjacent a user;

a portable electronic device with a keyboard is secured to the upper flat surface of the board to provide a load;

a leg assembly attached to the front half of the lower flat surface of the board;

said leg assembly includes a pair of feet and each of the feet are elongated cylindrical in shape and include a friction enhancing surface;

said friction enhancing surface includes a resilient material and ridges that are substantially parallel with the elongation of the foot;

a tension strap attached to the front two corners of the upper flat surface of the board and extending around a portion of the recliner armchair between the angular adjustable back and the chair arms;

wherein the board with the portable electronic device pivots around the feet to a plurality of angular orientations including a substantially horizontal position by resting each foot on one of the arm rests of said recliner armchair and balancing the board with the load by adjusting the length of the tension strap around the chair.

2. The laptop desk of claim 1, wherein the flat surface board comprises a plurality of hooks at the front left and front right ends of the flat surface board that detachably attach to the tension strap.

3. The laptop desk and chair apparatus of claim 2 wherein the tension strap comprises:

a strap end union joining two tension strap portions;

a plurality of glide type strap length adjusters;

a first tension strap end and a second tension strap end, each of said first and second tension strap ends comprising a plurality of eyelet apertures wherein said eyelet apertures selectively and detachably attach to said hooks of the flat surface board to provide strap length adjustments for controlling gravitational rotation of the flat surface board and wherein angular orientation the flat surface board is adjusted by pivoting the hooks about the strap eyelets.

4. The laptop desk of claim 1, wherein the flat surface board comprises a front raised border and a rear raised border defined by:

at least one pegboard area having a plurality of holes;

a plurality of mouse pad areas on front left and front right sides of the flat surface board;

a plurality of accessory strap slots throughout the at least one pegboard area; and at least one accessory strap threaded through accessory strap slots for securing a laptop computer or other desk top accessory to the board.

5. The laptop desk of claim 4, wherein the flat surface board includes at least one peg hook having a first terminal end and a second terminal end, each terminal end being inserted to a pair of holes on the at least one pegboard area to provide support for desktop accessories.

6. The laptop desk of claim 1, wherein the leg assembly comprises:

at least one axle housing having a pair of desk mounts and at least one welded nut;

at least one axle having a pair of ends adapted for insertion into the at least one axle housing;

at least one spring loaded pop pin threadably engaged with the at least one welded nut;

a pair of reducer couplings, each being attached to one end of the at least one axle;

at least one axle extension having at least one spring button connected to the at least one axle by way of the pair of reducer couplings; and a pair of adjustable leg portions engaged with the at least one axle extension through the at least one spring button, wherein the pair of adjustable leg portions engage the axle extension by way of spring buttons and spring button apertures for adjusting the width of the leg assembly so that the elongated cylindrical feet of the leg assembly can be centered on the armrests of the recliner armchair, and wherein the pair of adjustable leg portions also comprise a second plurality of spring button apertures and spring buttons for adjusting the height of the pair of adjustable leg portions.

7. The laptop desk of claim 1, wherein tension from tension strap and friction from leg assembly feet collaboratively balance the desk on the armrests of the recliner armchair.

* * * * *